US006314592B1

(12) United States Patent
Stein

(10) Patent No.: US 6,314,592 B1
(45) Date of Patent: Nov. 13, 2001

(54) BATH SEAT

(76) Inventor: Julie Stein, 19158 Golden Meadow Way, Noblesville, IN (US) 46060

( * ) Notice: Subject to any disclaimer, the term of this patent is extended or adjusted under 35 U.S.C. 154(b) by 0 days.

(21) Appl. No.: 09/639,447

(22) Filed: Aug. 15, 2000

(51) Int. Cl.[7] ..... A47K 3/022; A47K 3/12
(52) U.S. Cl. ..... 4/579; 4/572.1; 4/578.1
(58) Field of Search ..... 4/571.1–573.1, 4/578.1, 579, 583, 586, 546; 297/137, 250.1, 467

(56) References Cited

U.S. PATENT DOCUMENTS

D. 332,529 * 1/1993 Shuler ..... D6/333
5,071,192 * 12/1991 Adler ..... 4/572.1
5,158,460 * 10/1992 Bernstein et al. ..... 4/572.1
5,687,433 * 11/1997 Garner et al. ..... 4/572.1
6,112,343 * 9/2000 Dixon ..... 4/572.1

* cited by examiner

*Primary Examiner*—Gregory L. Huson
*Assistant Examiner*—Tuan Nguyen
(74) *Attorney, Agent, or Firm*—Woodard, Emhardt, Naughton, Moriarty & McNett

(57) ABSTRACT

A child's bath seat having a base, a top shelf portion with a generally triangular aperture formed therein, a plurality of support members extending between the base and the top shelf portion and at least one tether extending from a support member and terminating in a suction cup. In addition, a plurality of clips are connected to at least some of the respective support members. The clips extend partially over the base and exert a clamping force thereon. The clamping force urges any object positioned therebetween, such as a washrag, toward the base.

5 Claims, 3 Drawing Sheets

BATH SEAT

TECHNICAL FIELD OF THE INVENTION

The present invention relates generally to bath seats and, more particularly, bath seat for a child or infant.

BACKGROUND OF THE INVENTION

Infants and young children are typically incapable of sitting up and supporting themselves while getting a bath. Such support is important, since small children tend to be top-heavy and can easily topple over into their bath water. A caregiver bathing a small child must therefore provide not only cleanse the child, but also provide constant support to prevent the child from injury from falling over in the tub and/or from inhaling bath water.

One means for the caregiver to prove support is for the caregiver to continuously hold onto the child during the bathing process. This is usually difficult for a single caregiver to do, as wet, soapy young children tend to be slippery, all the more so if they squirm. Further, it is undesirable for an individual caregiver to have to constantly hold onto a child during bathing, since this leaves only one free hand with which to actually bath the child. Bathing a child one-handedly increases the likelihood of introducing soapy water into the child's eyes, nose, and/or mouth, causing the child discomfort and actuating even more vigorous squirming.

Another means for supporting a small child at bath time is through the use of a support device. Such devices generally include a support ring or shelf supported by a plurality of support members attached to a base. Examples of such devices are described in U.S. Pat. No. 5,158,460 issued Oct. 27, 1992 to Bernstein et al. and U.S. Pat. No. 5,687,433 issued Nov. 18, 1997 to Garner et al. These devices typically include suction cups attached to the base to adhere the bath seat to the bathtub while a child seated therein is being bathed. The base portion functions as the seat while the support members and/or the ring or shelf functions as a front and rear support. The base may have a non-slip surface to prevent the child from sliding within the seat.

While these bath seat devices are adequate to provide some support to a child getting a bath in a tub having a smooth floor, they base-mounted suction cups are less effective in anchoring the seat to a tub having a textured floor. Further, the circular design of the support shelf necessitates a shelf ring having a diameter sized only slightly wider than the child in order to provide adequate support and restraint during the child's bath, making it difficult to insert, adjust, and remove the child from the seat. Also, the non-slip seat surface (in those seats having one) is typically a textured rubber coating, which is somewhat uncomfortable against the child's skin and may cause chafing or abrasion if the child squirms vigorously during bathing.

There is therefore a need for a bath seat capable of securely containing a child during bath time that can be securely anchored in a textured bath tub, that has a comfortable non-skid seat, and that is readily accessible to the caregiver. The present invention is directed toward meeting this need.

SUMMARY OF THE INVENTION

The present invention relates to a child's bath seat having a base, a top shelf portion with a generally triangular aperture formed therein, a plurality of support members extending between the base and the top shelf portion and at least one tether extending from a support member and terminating in a suction cup. in addition, a plurality of clips are connected to at least some of the respective support members. The clips extend partially over the base and exert a clamping force thereon. The clamping force urges any object positioned therebetween, such as a washrag, toward the base.

One object of the present invention is to provide an improved bathtub seat. Related objects and advantages of the present invention will be apparent from the following description.

DETAILED DESCRIPTION OF THE PREFERRED EMBODIMENT

Figure 1:
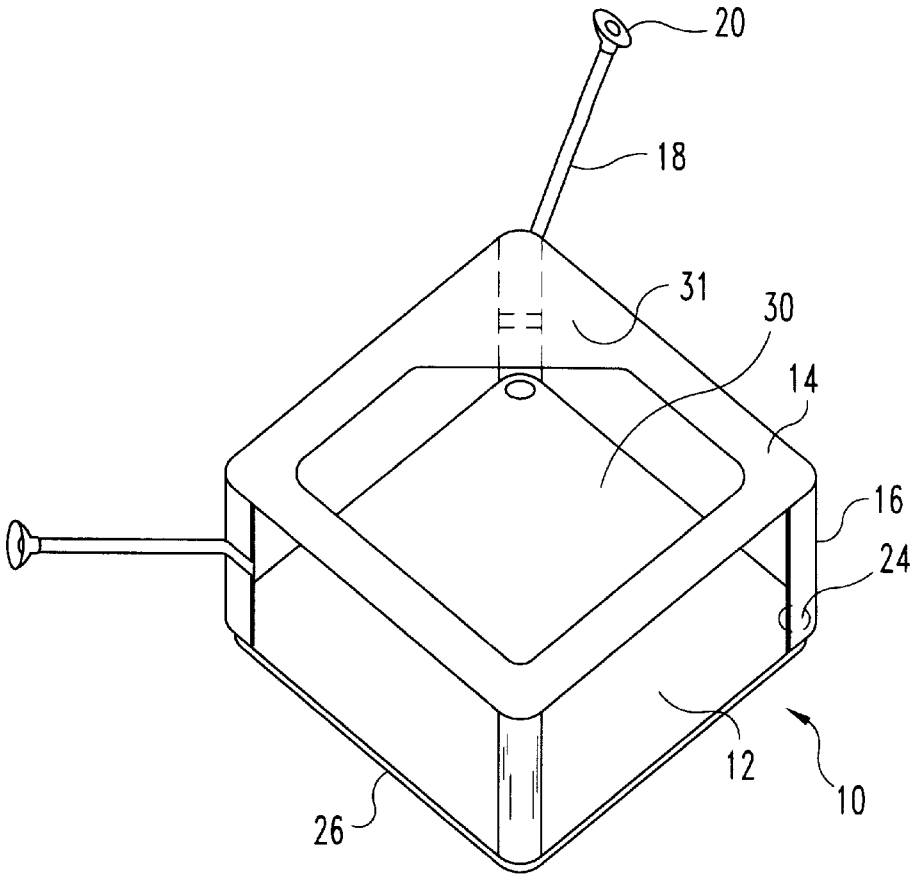
FIG. 1 is a perspective view of a first embodiment bath seat of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIGS. 1 illustrates a first embodiment of the present invention, a diamond-shaped bath seat 10. The bath seat includes a base portion 12 connected to a top portion 14 by a plurality of spaced support members 16. The edges of the base portion 12, top portion 14, and support members 16 are preferably rounded. There are preferably four support members 16, and the support members 16 preferably extend between the corners of the base portion 12 and the top portion 14, although there may alternately be any convenient number of support members 16 positioned at any convenient locations on the bath seat 10. The at least some of the support members 16 are preferably spaced such that a child may extend a leg therebetween.

The bath seat additionally includes at least one, and more preferably a plurality of, tether lines 18 connected thereto. The tether lines 18 each have an anchor device (such as a suction cup) 20 attached to their respective distal ends. The bath seat also includes one or more clips 24 attached to the top side of the base portion 12 for securing a washcloth thereto. Each clip 24 is adapted to exert an urging force downward onto the base portion 12, or onto a washcloth positioned between the clips 24 and the base portion 12. The bath seat 10 also preferably includes a textured rubber undercoat 26 for preventing unintentional movement of the bath seat 10 over the bathtub floor.

The bath seat 10 features a generally triangular aperture 30 formed in the top portion 14. The aperture 30 is shaped such that a child may be easily passed therethrough. The generally triangular shape of the aperture 30 also limits the child's range of motion such that the child will be restrained while seated. The child is preferably seated such that the he is facing the apex of the triangle with his leg extending around the support member 16 positioned substantially therebeneath. The aperture 30 is positioned in the top portion 14 so as to leave a relatively spacious shelf area 31 behind a child occupying the preferred seating orientation. The shelf area 31 may be used to rest cleaning articles such as soap, shampoo, or the like while not in use.

Figure 2:
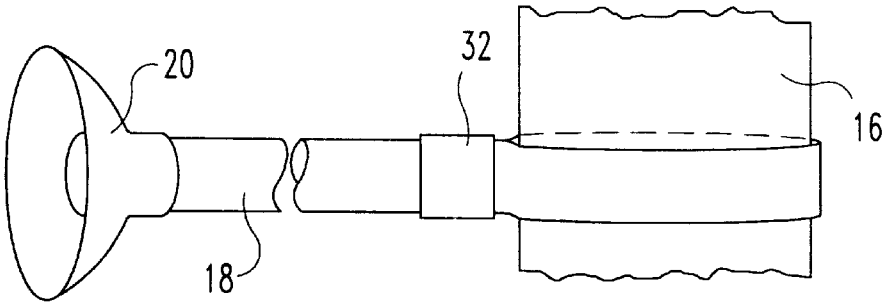
FIG. 2 is an enlarged partial side plan view of a tether and support member of the embodiment of FIG. 1.

Referring to FIG. 2, the tether lines 18 are preferably removably connected to one or more of the support members 16, although they may be attached to any convenient point on the bath seat 10. FIG. 2 illustrates a tether line 18 encircling a support member 16 and fastened thereto by a fastener 32. The fastener 32 is preferably of a convenient type known in the art, such as a metal or plastic clip or the like. The tether line 18 is preferably a flexible, substantially flat member and is preferably made of a tough material such as nylon, and is more preferably about forty-five centimeters in length. The terminal end of the tether line is connected to an anchor device 20 adapted to fasten to the side of the tub or to the wall. The anchor device 20 is preferably a suction cup. The suction cup 20 is preferably made of a pliable, resilient material such as rubber or plastic and is adapted to adhere to a relatively smooth, flat surface.

Figure 3:
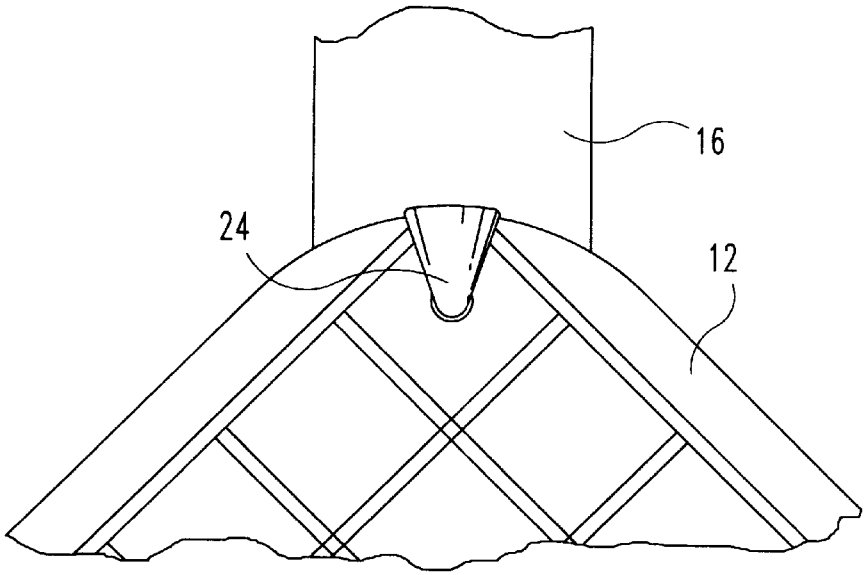
FIG. 3 is a partial perspective view of a support member, clip, and base portion FIG. 1.

FIG. 3 illustrates a clip 24 is shown holding the corner of a washcloth to the base portion 12. There are preferably four clips 24 connected to the bath seat 10, each clip 24 preferably extending inwardly from the joint of the base portion 12 and a support member 16. The clips 24 are preferably leaf springs or the like, and may be easily lifted to insert or remove a portion of a washcloth thereunder. Each clip 24 preferably provides sufficient clamping force on a washcloth positioned between the clip 24 and the base portion 12 to securely hold a washcloth against the base portion while a child is sitting thereupon while being bathed, but not so much clamping force as to make removal of the washcloth for laundering difficult.

Figure 4B:
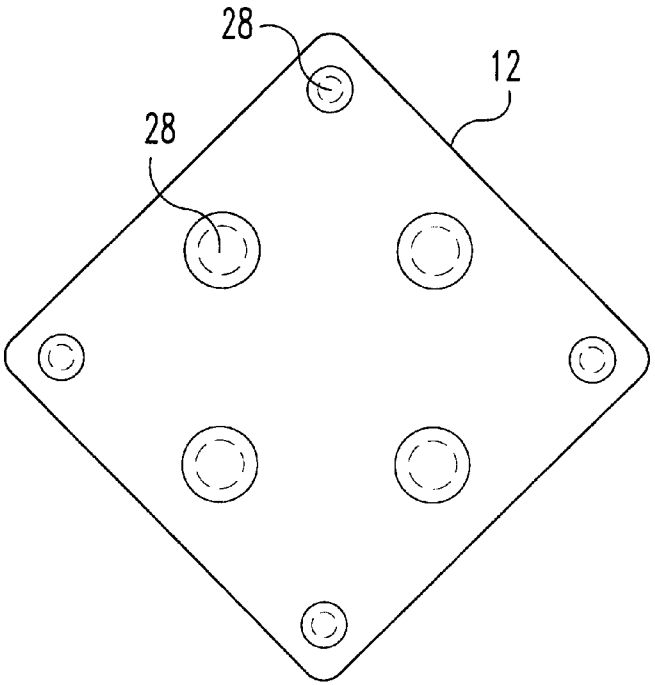
FIG. 4B is a bottom elevational view of FIG. 1 having a plurality of suction cups attached thereto.
Figure 4A:
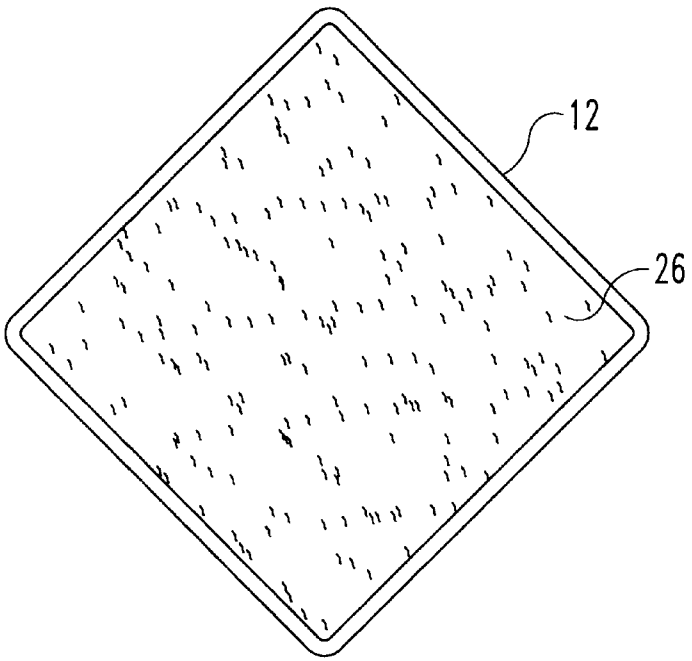
FIG. 4A is a bottom elevational view of FIG. 1 having a textured undercoat.

Referring to FIGS. 4A and 4B, the bottom side of the base portion 12 is illustrated. FIG. 4A shows the base portion 12 having a textured undercoat layer 26 affixed thereto. The undercoat layer 26 is textured to prevent or minimize slippage against a slick surface, and is preferably formed from a resilient material such as rubber or plastic. FIG. 4B illustrates an alternate configuration of the bottom side of the base portion 12, in which a plurality of suction cups 28 are affixed to thereto. The suction cups 28 may be of any type commonly known in the art. Referring back to FIG. 4A, it is also contemplated that the textured undercoat 26 include miniature suction cups or recesses formed therein.

Figure 5:
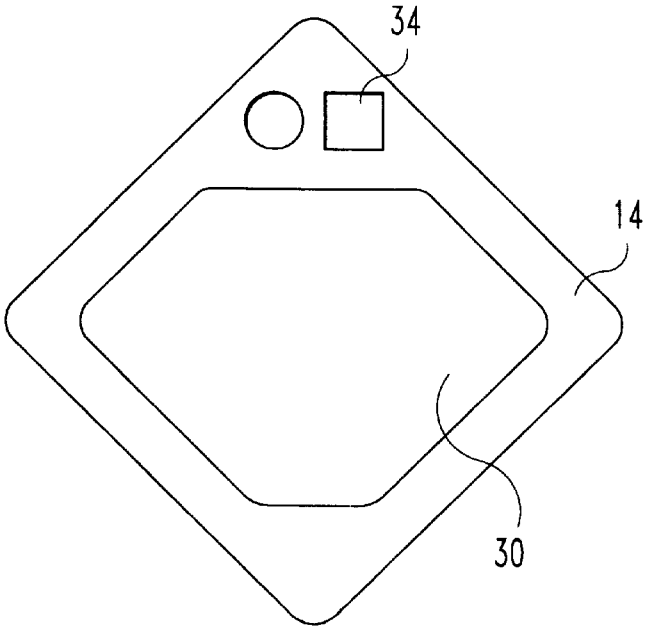
FIG. 5 is a top plan view of the top portion of FIG. 1 having a plurality of shaped recesses formed therein.

FIG. 5 illustrates a variation of the top portion 14, wherein the aperture 30 has the general shape of a truncated triangle, such that a child seated therein in the preferred orientation is more restrained from forward movement, and has a small, flat area upon which to place bath toys. Likewise, a bath toy or toys could be permanently mounted thereto to provide distraction and amusement during the bath. Also, the top portion 14 further includes one or more shaped recesses 34 formed therein to accommodate bath supplies, such as soap or shampoo bottles.

The base portion 12, top portion 14 and support members 16 are preferably formed from a substantially lightweight structural material having sufficient resiliency to at least partially elastically deform under impact, such as plastic.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are to be desired to be protected.

What is claimed is:

1. A bath seat, comprising:

a base;

a substantially flat top portion having a generally triangular aperture formed therein;

a plurality of support members extending between the base and the top portion;

at least one tether extending from a support member and terminating in a suction cup; and a plurality of clips connected to the respective support members and extending partially over the base;

wherein the clips are adapted to secure a washcloth to the base.

2. The bath seat of claim 1 wherein the base is generally diamond-shaped.

3. The bath seat of claim 1 wherein the base includes a textured undercoat layer.

4. The bath seat of claim 1 wherein the base includes a plurality of suction cups connected thereto.

5. The bath seat of claim 1 wherein the top portion further includes at least one recess formed therein.

* * * * *

UNITED STATES PATENT AND TRADEMARK OFFICE

CERTIFICATE OF CORRECTION

PATENT NO. : 6,314,592 B1
DATED : November 13, 2001
INVENTOR(S) : Stein

It is certified that error appears in the above-identified patent and that said Letters Patent is hereby corrected as shown below:

Column 1,
Line 44, replace "they" with -- the --.

Signed and Sealed this

Twenty-eighth Day of May, 2002

*Attest:*

*Attesting Officer*

JAMES E. ROGAN
*Director of the United States Patent and Trademark Office*